US006783330B2

(12) United States Patent
Carnes et al.

(10) Patent No.: US 6,783,330 B2
(45) Date of Patent: Aug. 31, 2004

(54) SELF-PRIMING CENTRIFUGAL PUMP

(75) Inventors: William M. Carnes, Milwaukie, OR (US); Michael C. Godish, Portland, OR (US)

(73) Assignee: Pioneer Pump, Inc., Canby, OR (US)

( * ) Notice: Subject to any disclaimer, the term of this patent is extended or adjusted under 35 U.S.C. 154(b) by 15 days.

(21) Appl. No.: 10/217,074

(22) Filed: Aug. 12, 2002

(65) Prior Publication Data

US 2003/0039555 A1 Feb. 27, 2003

Related U.S. Application Data

(60) Provisional application No. 60/311,517, filed on Aug. 11, 2001.

(51) Int. Cl.[7] ..... F04D 9/04

(52) U.S. Cl. ..... 417/200; 417/201; 137/202; 137/434

(58) Field of Search ..... 417/200, 201, 417/202, 203; 137/202, 192, 271, 434, 445

(56) References Cited

U.S. PATENT DOCUMENTS

| | | | | |
|---|---|---|---|---|
| 1,119,979 | A | * 12/1914 | Mulligan | 137/202 |
| 1,162,262 | A | * 11/1915 | Steedman | |
| 1,201,594 | A | 10/1916 | King | |
| 1,453,574 | A | * 5/1923 | Trotzer | |
| 1,475,994 | A | * 12/1923 | Havens | |
| 1,573,706 | A | * 2/1926 | Haentjens | |
| 1,573,931 | A | 2/1926 | Goyne | |
| 1,583,099 | A | * 5/1926 | Rayfield | |
| 1,591,346 | A | * 7/1926 | Tushaus et al. | |
| 1,609,582 | A | * 12/1926 | Snider | |
| 1,638,160 | A | * 8/1927 | Johnson | |
| 1,803,885 | A | 5/1931 | Adams | |
| 1,825,776 | A | * 10/1931 | Brubaker | 137/202 |
| 1,840,257 | A | 1/1932 | Saxe et al. | |
| 1,892,849 | A | * 1/1933 | Rayfield | |
| 1,910,775 | A | 5/1933 | Saxe | |
| 1,929,232 | A | 10/1933 | Adams | |
| 1,971,774 | A | 8/1934 | Durdin, Jr. | |
| 2,033,744 | A | * 3/1936 | Skidmore | 137/202 |
| 2,162,247 | A | 6/1939 | Dean et al. | |
| 2,191,326 | A | * 2/1940 | Smith et al. | |
| 2,192,442 | A | 3/1940 | Hoffman | |
| 2,216,975 | A | 10/1940 | Jauch | |
| 2,231,523 | A | 2/1941 | Jauch et al. | |
| 2,232,280 | A | 2/1941 | Southern | |
| 2,258,495 | A | 10/1941 | Jauch et al. | |
| 2,384,172 | A | 9/1945 | Jauch et al. | |
| 2,845,875 | A | 8/1958 | Corbett | |
| 3,230,890 | A | 1/1966 | Yokota et al. | |
| 3,363,643 | A | * 1/1968 | Skulski | 137/445 |
| 3,591,316 | A | 7/1971 | Piccirilli | |
| 3,599,659 | A | * 8/1971 | Nuter et al. | 137/202 |
| 4,249,865 | A | 2/1981 | Sloan | |
| 6,315,524 | B1 | 11/2001 | Muhs et al. | |
| 6,409,478 | B1 | 6/2002 | Carnes et al. | |

FOREIGN PATENT DOCUMENTS

| | | |
|---|---|---|
| GB | 555256 | 8/1943 |
| GB | 1048272 | 11/1966 |
| GB | 1050893 | 12/1966 |
| GB | 1352507 | 5/1974 |

* cited by examiner

*Primary Examiner*—Michael Koczo
(74) *Attorney, Agent, or Firm*—Howrey Simon Arnold & White, LLP

(57) ABSTRACT

A priming vacuum control system for use on a self-priming pump includes a priming vacuum control valve and a priming vacuum control valve-actuating system. The priming vacuum control valve is disposed between a vacuum pump and a priming chamber for the self-priming pump so as to decouple the vacuum communication between the vacuum pump and the priming chamber when the priming vacuum control valve is closed. In one illustrative embodiment, the priming vacuum control valve includes: a valve stem positioned within a valve body, and a valve spring or other means for biasing is operatively positioned between the valve body and the valve stem so as to apply a default closing force between the valve body and the valve stem. The "guideless" priming vacuum control valve of the present invention eliminates the inherent problems of sticking, poor performance and high maintenance exhibited by the prior state of the art priming vacuum control valves containing guides.

27 Claims, 5 Drawing Sheets

SELF-PRIMING CENTRIFUGAL PUMP

CROSS REFERENCES TO RELATED APPLICATIONS

This application claims priority to U.S. Provisional Application Serial No. 60/311,517 filed Aug. 11, 2001.

BACKGROUND OF THE INVENTION

One of the most common pumps for moving liquids or liquids containing suspended solids from place to place are centrifugal pumps. Typical applications include: irrigation, domestic water systems, sewage handling, pumping of drilling fluids or drilling muds, drainage of construction sites or underground structures and other such applications well known in the art.

Functionally, fluid is drawn through the pump by a spinning impeller positioned inside an annular volute. The volute has an eye at the center where water enters the pump and is directed into the center of the impeller. The rotation of the impeller flings the liquid outward to the perimeter of the impeller where it is collected in the volute for discharge out of the pump. As the liquid is driven outward because of the centrifugal force of the rotating impeller, a vacuum is created at the eye, which tends to draw more fluid into the pump.

A well-known limitation to the use of centrifugal pumps is their limited ability to draw fluid for self-priming when starting from an air-filled or dry condition. This difficulty is because the impeller is not capable of generating a sufficient vacuum when operating in air to draw liquid up to the pump when the standing level of the liquid is below the pump. Until liquid reaches the impeller, very little draw is generated by the impeller. Thus to begin pumping, the pump must either be primed manually or be self-priming.

Self-priming centrifugal pumps are well known, for example see U.S. Pat. No. 6,409,478, which describes a current state of the art self-priming centrifugal pump. Such pumps utilize a vacuum pump, such as a diaphragm pump, to supplement the minimal vacuum generated by the rotating impeller to draw sufficient water into the pump so that the pump may properly function.

With reference to FIG. 1, a self-priming centrifugal pump 2 is shown having a centrifugal section 4 operatively coupled to a vacuum priming section 6 and a vacuum pump 8. The centrifugal section 4 generally includes an intake 10 through which fluid is drawn by the impeller 12. The impeller 12 rotates on an impeller shaft 14 mounted in a bearing housing and operatively coupled to a means for driving the impeller shaft 14, such as an electric motor or combustion engine (not shown). As noted above, the rotation of the impeller 12 causes the fluid to be flung into the volute 16 and in turn the discharge outlet 18. A check valve 20 is used to substantially prevent the back-flow of discharged fluid into the volute 16. The process of self-priming in such a pump is well known in the art. Upon rotation of the impeller shaft 14, an operatively coupled vacuum pump 8 creates a vacuum, which is conducted to the vacuum priming section 6 by a vacuum hose 22. The vacuum draws fluid into the centrifugal section 4 and the vacuum priming section 6 thus priming the centrifugal pump 2.

Although centrifugal pumps are relatively simple and reliable, in the past, the valves and vacuum pumps used for self-priming have proven less reliable. As shown in FIG. 2 a current state of the art vacuum priming control system, such as that disclosed in U.S. Pat. No. 6,409,478, utilizes a vacuum-priming valve 24 which includes a valve body 25 connected to the vacuum pump (not shown) by the vacuum hose 22. The valve body 25 includes a valve stem guide, which guides the valve stem 28. The valve stem 28 works in conjunction with the valve seat to form a vacuum tight seal when the valve is closed, as is shown in FIG. 2. The lower end of the valve stem 28 is connected to a valve stem connecting rod 32, which in turn is connected to an upper compound lever arm 34. The upper compound lever arm 34 includes a pivot point 36, which is pivotally connected to bracket 38. A vertical connecting arm 40 is connected to the end of the upper compound lever arm 34 opposite that of valve stem connecting rod 32. The vertical connecting arm 40 is operatively coupled to the lower compound lever arm 42. The lower compound lever arm 42 is pivotally coupled to the bracket 38 at a lower pivot point 44. The lower compound lever arm 42 is also coupled to a float connecting rod 46 and float 48. In operation, when the fluid level in the vacuum priming section is low, the float 48 is drawn down by gravity and the gravitational force is transferred by way of the series of connecting arms to the valve stem 28. The transferred force opens the valve and thus allows a vacuum communication between the vacuum pump and the vacuum priming section. When the fluid level in the vacuum priming section is sufficiently high, the float is forced upward due to the buoyancy of the float 48. The force generated by the buoyancy of the float 48 is transferred by the series of connecting arms to the valve stem 28. The transferred force closes the valve, which prevents the fluid from being drawn up into the vacuum hose and thus the vacuum pump.

One of skill in the art should appreciate that the above prior art system may function well under certain ideal circumstances, however in many cases in actual operation the level of fluid in the vacuum priming section may be subject to variable and random level changes or turbulence which results in valve chatter. That is to say, the valve may be subjected to periodic opening and closing resulting in small amounts of fluid being drawn into the valve body. In certain circumstances, such as when fine suspended particles are contained within the fluid being pumped detritus and abrasive fine particles accumulate in the valve body and on the valve stem and valve guide. This accumulation of detritus and abrasive fine particles results in the binding of the valve stem within the valve guide and the overall deterioration of the functioning of the valve. In order to prevent this, substantial and time consuming maintenance must be performed on the vacuum priming valve to ensure proper functioning.

As a result of the above, there is a continuing and unmet need for a priming vacuum control system that is not subject to the chattering of the priming vacuum control valve when turbulence is experienced in the priming chamber. Further, there remains and exists a need for a priming vacuum control valve that is easy to maintain, and is not subject to the clogging, binding, and other functionally disruptive concerns exhibited by the current state of the art priming vacuum control valves described above.

SUMMARY OF THE INVENTION

The present invention is generally directed to a priming vacuum control system for use on a self-priming pump. Such a system includes a priming vacuum control valve and a priming vacuum control valve-actuating system. The priming vacuum control valve is disposed between a vacuum pump and a priming chamber for the self-priming pump so as to decouple the vacuum communication between the vacuum pump and the priming chamber when the priming vacuum control valve is closed.

In one illustrative embodiment of the present invention, the priming vacuum control valve includes: a valve stem positioned within a valve body, and a valve spring or other means for biasing, operatively positioned between the valve body and the valve stem so as to apply a default closing force between the valve body and the valve stem. One of skill in the art should understand and appreciate that the priming vacuum control valve of the present invention is a "guideless" valve in that the valve stem is held in operative position by virtue of the default closing tension applied to the valve stem by the valve spring. That is to say, the relative axial position of the valve stem within the valve body is allowed to float and is not determined by the use of a valve stem guide as described by the prior art. Because the present invention eliminates the valve stem guide, the priming vacuum control valve of the present invention eliminates the inherent problems of sticking, poor performance and high maintenance exhibited by the prior art priming vacuum control valves.

The priming vacuum control valve is opened by the action of a priming vacuum control valve-actuating system. In one illustrative embodiment of the present invention, the priming vacuum control valve-actuating system includes a series of interconnected compound lever arms including an upper compound lever arm operatively connected to a float. The upper compound lever arm has a valve-actuating end which is disengagedly coupled to the lower end of the valve stem. The priming vacuum control valve-actuating system is designed such that a downward motion of the float within the priming chamber because of a lowering of fluid level within the priming chamber results in the transfer of a valve opening force to the upper compound lever arm. The valve-actuating end of the upper compound lever arm frictionally engages the lower portion of the valve stem and thus opens the priming vacuum control valve. One of skill in the art upon review and consideration of the present invention will appreciate that any valve chattering caused by the slight and/or irregular motion of the float within the priming chamber is significantly decreased.

The present invention also includes a self-priming pump, preferably a centrifugal pump that includes the priming vacuum control systems of the present invention. Also within the scope of the present invention is a priming vacuum control valve as is described herein for use with self-priming centrifugal pumps. The present invention also encompasses a method of retrofitting a self-priming centrifugal pump with the priming vacuum control systems of the present invention.

These and other features of the present invention are more fully set forth in the following description of preferred or illustrative embodiments of the invention.

BRIEF DESCRIPTION OF THE DRAWINGS

The description of the prior art in the Background is presented with reference to the accompanying drawings in which.

Figure 3:
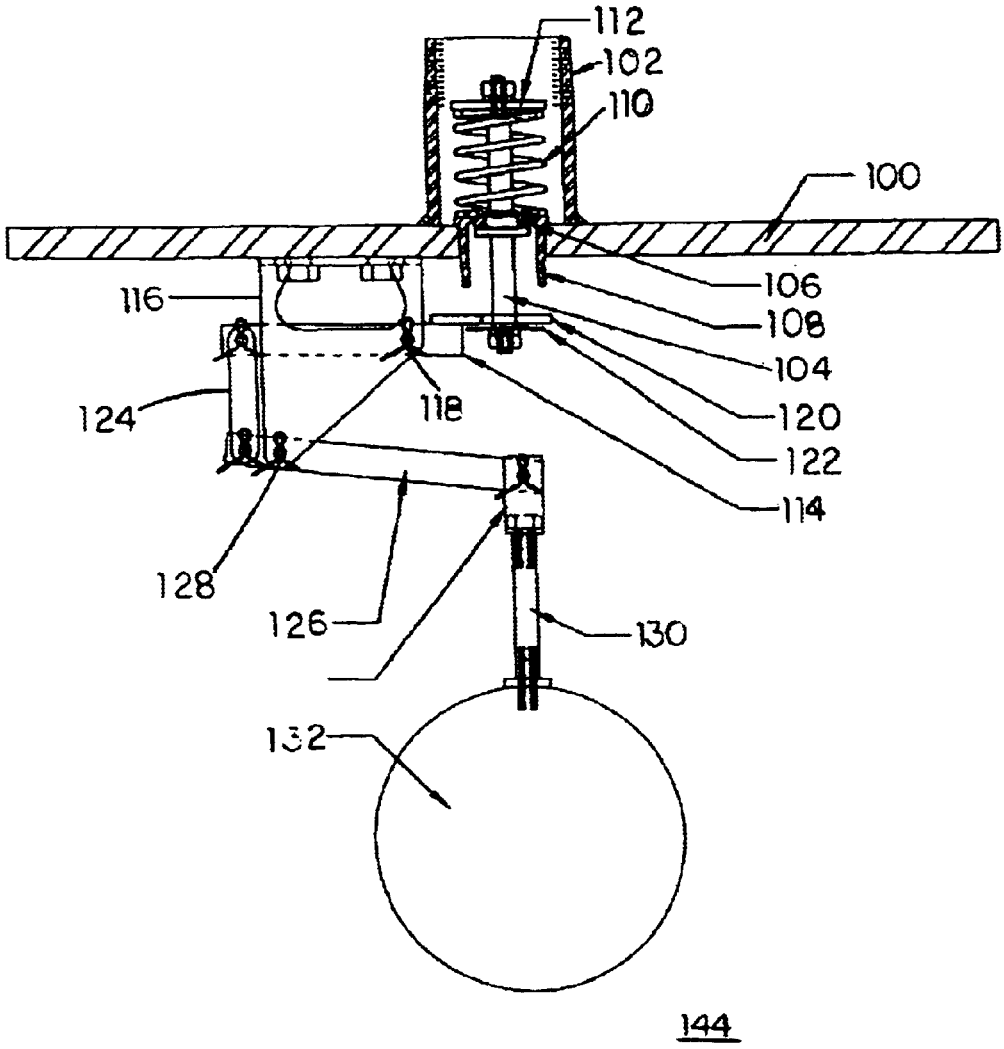

The Description of the Illustrative Embodiments of the present invention is presented with reference to the accompanying drawings in which:

FIG. 3 is a schematic diagram of a priming vacuum control system of the present invention.

Figures 4, 5:
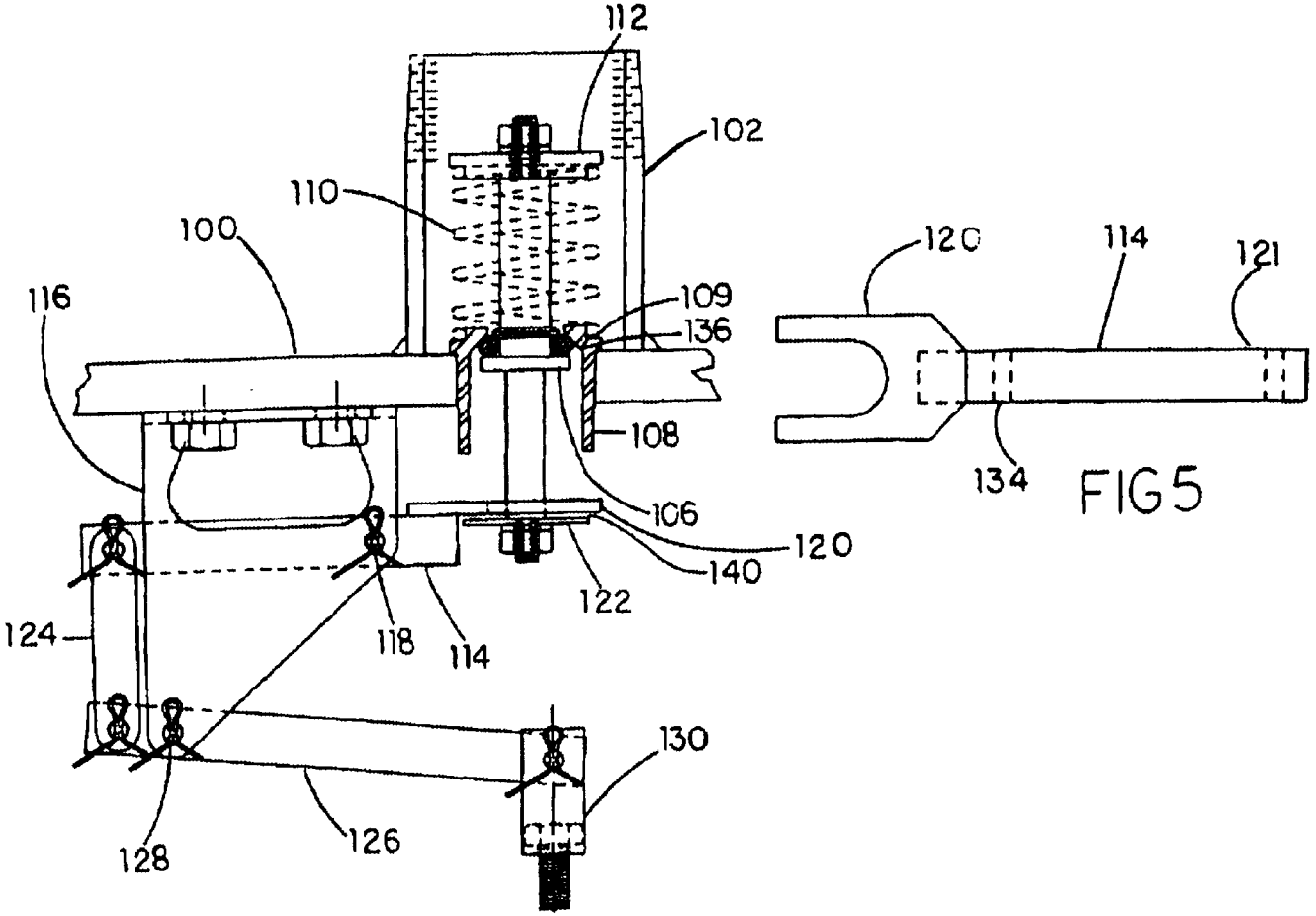

FIG. 4 is a schematic diagram of a priming vacuum control system of the present invention.

FIG. 5 is a top view schematic diagram of the upper compound lever arm used in the priming vacuum control system of the present invention.

Figure 6:
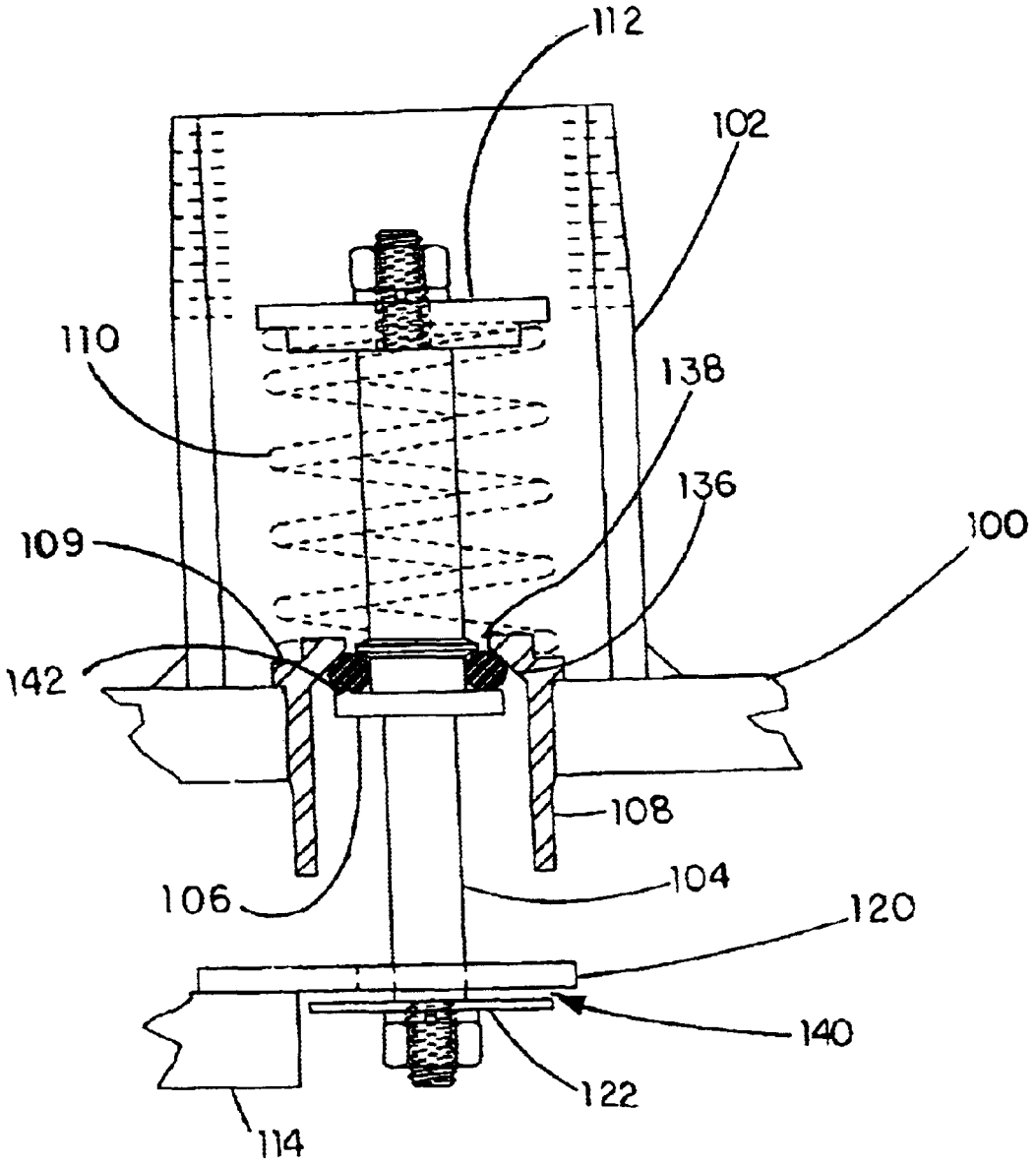

FIG. 6 is a detailed view of the priming vacuum control valve of the present invention.

DESCRIPTION OF ILLUSTRATIVE EMBODIMENTS

Turning now to FIGS. 3, 4 and 6, shown is a schematic diagram of one illustrative embodiment of the present invention installed in the vacuum priming section 100 of a self-priming centrifugal pump as is generally described above. The valve body 102 of the present embodiment is designed so that the vacuum hose (not shown) and hence the vacuum pump (not shown) can be operatively coupled to the valve body 102 as should be apparent to one of ordinary skill in the art. Although the valve body 102 shown is generally cylindrical, the valve body 102 may also include angled elbows to facilitate the connection of the vacuum hose. Such modification should be apparent to one of skill in the art.

Operatively positioned within the valve body 102 is a valve stem 104, which is designed so as to have an upper valve stem end and a lower valve stem end. Between the two ends, a means for forming a vacuum tight seal with the vacuum body is positioned. As the term is generally used herein, the means for forming a vacuum tight seal is referred to as a valve stem seal 106. The valve stem seal 106 is of a shape and size such that it works in cooperation with the valve body 102 and valve body seat 136 (both of which are described in greater detail below) to form a vacuum tight seal. A vacuum tight seal, as the term is used in this disclosure, is a seal that is sufficient to prevent the excessive loss of vacuum generated by the vacuum pump. In other words, a vacuum tight seal decouples the vacuum communication between the vacuum pump and the priming chamber that otherwise would exist. In one preferred and illustrative embodiment, the valve stem seal 106 is composed of a valve stem seal shoulder 142 positioned between the two ends of the valve stem, and an o-ring or other elastic sealing member.

In the illustrative embodiment shown in FIGS. 3, 4 and 6, the valve body 102 defines a valve body opening 138 which has a vacuum pump side and a priming chamber side. The valve body opening 138 serves as a path for vacuum communication between the vacuum pump and the priming chamber when the valve is open. Within the valve body opening 138 is a tapered valve body seat 136, which is designed to cooperatively work with the valve stem seal 106 to form a vacuum tight seal. A splash shroud 108 substantially surrounds the priming chamber side of the valve body opening 138. The purpose of the splash shroud 108 is to minimize the splashing of fluid in the priming chamber into the valve body opening 138 and thus potentially into the vacuum pump.

Also included in the illustrative embodiment is a biasing means seat 109 that substantially surround the vacuum pump side of the valve body opening 138. The purpose of the biasing means seat 109 is to provide for a secure seating of the biasing means 110 as it applies force to the valve body 102. In one illustrative and preferred embodiment, the biasing means seat 109 is a spring seat for a valve spring as is shown in FIGS. 3, 4 and 6.

A means for biasing 110 is operatively positioned so as to apply a default closing force between the valve body 102 and the valve stem 104 so as to form a vacuum tight seal between the valve stem seal 106 and the valve body seat 136.

Exemplary of such means is a valve spring, preferably a coil spring, however, other biasing means or springs, may be used to achieve substantially the same result. A means for retaining the biasing means in an operatively biasing relationship between the valve body 102 and the valve stem 104 is included in the present illustrative embodiment. Such means may include an upper valve stem cap 112 coupled to the upper valve stem end such that it compresses the biasing means 110 slightly. A biasing means seat may also be included as part of the valve body to ensure the proper positioning of the biasing means. In one preferred and illustrative embodiment, the means for retaining includes the combination of an adjustable upper valve stem cap 112 attached to the upper valve stem end and a spring seat around the outside vacuum pump side of the valve body opening. Alternatively, the means for retaining may be a plate or a perpendicular pin or some similar structure. In another illustrative embodiment, the position of the upper valve stem cap is vertically adjustable along the valve stem so as to permit the adjustment of the default closing force applied by the biasing means 110 between the valve stem seal 106 and the valve body seat 136. As is shown in FIG. 6 in greater detail, this may be accomplished by use of an upper valve stem cap 112 and adjusting a nut which is threaded onto valve stem threads.

One of skill in the art should understand and appreciate that the priming vacuum control valve of the present invention is a "guideless" valve in that the valve stem is held in operative position by virtue of the default closing tension applied to the valve stem by the valve spring. That is to say, the relative axial position of the valve stem within the valve body is allowed to float and is not determined by the use of a valve stem guide as described by the prior art. Because the present invention eliminates the valve stem guide, the priming vacuum control valve of the present invention eliminates the inherent problems of sticking, poor performance and high maintenance exhibited by the prior art priming vacuum control valves.

The present illustrative embodiment also includes a priming vacuum control valve-actuating system operatively coupled to the priming vacuum control valve. One such illustrative priming vacuum control valve-actuating system is shown in FIGS. 3, 4 and 6. As shown the system includes an actuator bracket 116, an upper compound lever arm 114, and a lower compound lever arm 126. The upper compound lever arm 114 and the lower compound lever arm 126 are pivotally mounted to actuator bracket at the upper pivot point 118 and the lower pivot point 128, respectively. The exemplary actuator bracket 116 is fixedly mounted inside the priming chamber by any suitable means. For example the actuator bracket 116 may be fixed using nuts and bolts (as shown) or welding, or it may be wholly incorporated in the structure of the priming chamber through casing and/or machining. The upper compound lever arm 114 has a valve-actuating end 120, a link arm end 121 and a pivot point 134 positioned between the valve-actuating end 120 and the link arm end 121 through which it is operatively coupled to the actuator bracket 116. The lower compound lever arm 126 has a link arm end and a float rod end and a pivot point positioned between the link arm end and the float rod end, by which the lower compound lever arm 126 is pivotally coupled to the actuator bracket at the lower pivot point 128. A link arm 124 is utilized in the illustrative embodiment to pivotally connect one end of the link arm to the link arm end of the upper compound lever arm and to pivotally connect the other end of the link arm to the link arm end of the lower compound lever arm. However, the link arm may be eliminated resulting the direct coupling of the upper and lower compound lever arm. In one such illustrative example the lower compound lever arm is modified so that it is generally triangular in shape and the pivoting motion of the lower compound lever arm results in the upward motion of the link arm end of the upper compound lever arm. Other such alternatives should be apparent to one of skill in the art and thus are contemplated as being part of the present invention. A float rod 130, which has a lower compound lever arm connecting end, is operatively coupled to the float rod end of the lower compound lever arm. The float rod is also operatively coupled on the other end, i.e. the float connecting end, to a float 132 in the priming chamber. The float may be of any suitable shape and size so long as it is capable of substantially vertical movement within the priming chamber in response to the fluid level in the priming chamber.

The illustrative system is designed such that the downward motion of the float within the priming chamber results in the transfer of a valve opening force to the lower portion of the valve stem. When the valve opening force is greater than the default closing force, the valve is opened.

Figure 1:
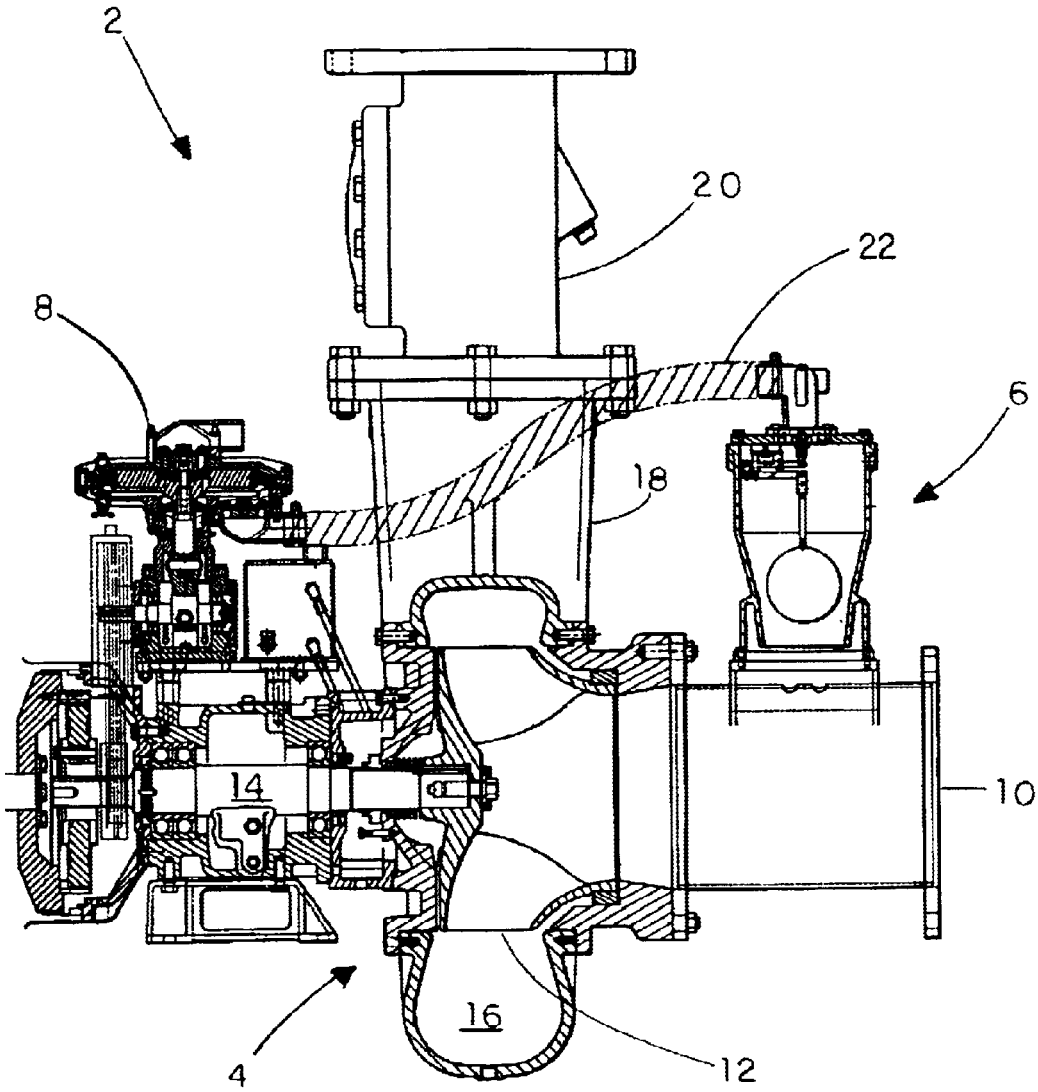
FIG1 (PRIOR ART)
FIG. 1 (Prior Art) is a schematic diagram of a state of the prior art self-priming centrifugal pump.
Figure 2:
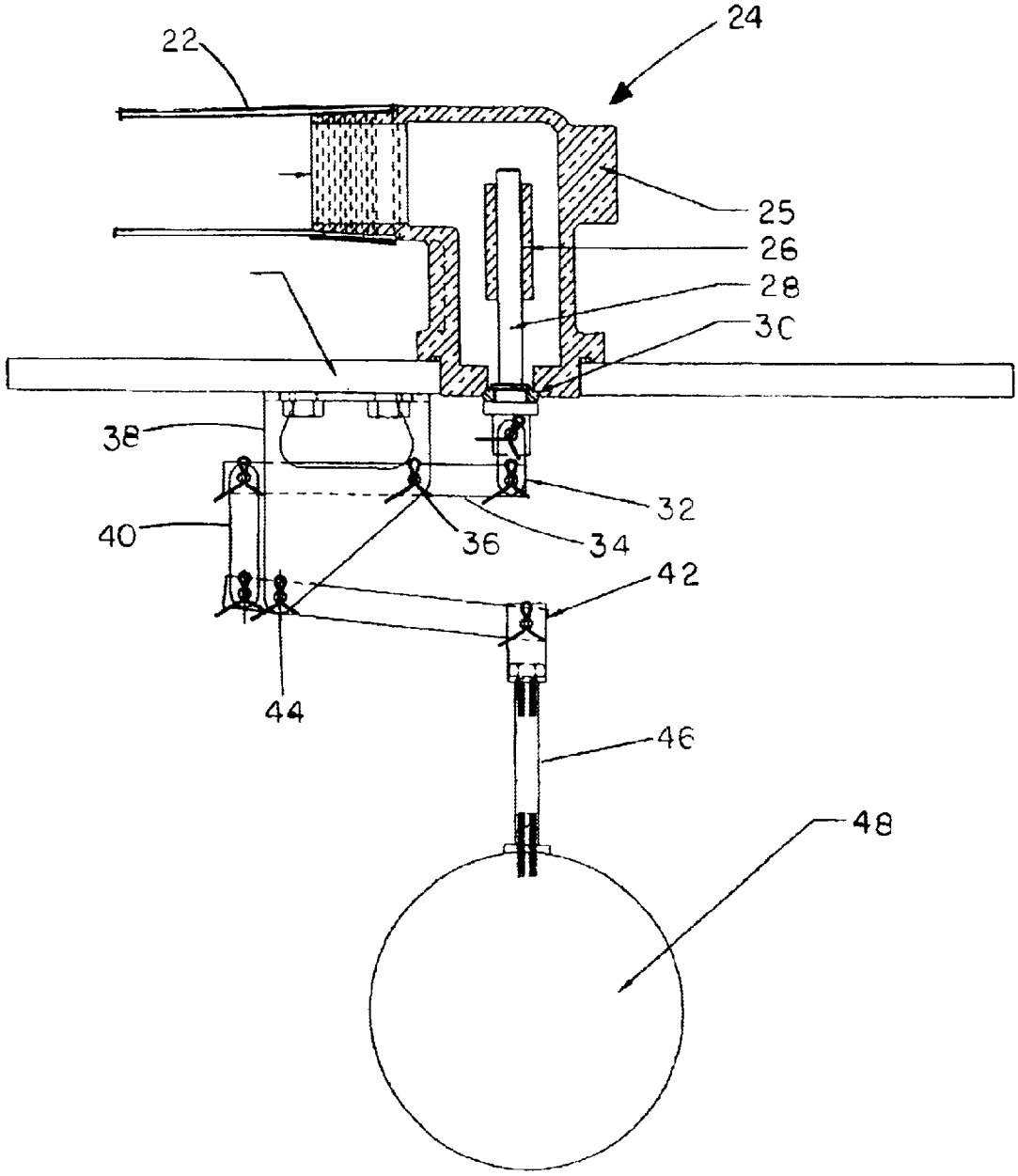
FIG2 (PRIOR ART)
FIG. 2 (Prior Art) is a detailed schematic diagram of a state of the prior art priming vacuum control system.

In one preferred and illustrative embodiment, the valve-actuating end of the upper compound lever arm 120 is fork shaped (i.e. "U" shaped) as is shown in FIG. 5. However, the valve-actuating end may be "J" shaped or "V" shaped. The precise shape of the valve actuating end is of little consequence, so long as the valve-actuating end is capable of being disengagedly coupled to the lower valve stem end. As the term "disengagedly coupled" is used herein, it is intended to mean that when the upward motion of the float results in a force that is less than the default closing force, the valve-actuating end of the upper compound lever arm is disengaged from the lower portion of the valve stem. Upon careful examination, such a condition is shown in FIGS. 4 and 6 where a gap 140, is illustrated and the valve-actuating end of the upper compound lever arm is disengaged from the lower valve stem end. However, as noted above, the downward motion of the float within the priming chamber results in the transfer of a valve opening force to the lower portion of the valve stem. When the valve opening force is greater than the default closing force, the valve is opened. This concept of "disengagedly coupling" results in the substantial reduction in the valve chatter caused by turbulence in the priming chamber. As previously noted valve chatter results from the direct linking of the priming valve to the priming valve actuating system as is shown in the prior art (see FIGS. 1 and 2). Thus a substantial benefit of the present invention is achieved by disengagedly coupling the valve-actuating end of the upper compound lever arm to the lower valve stem end. As illustrated in FIGS. 3, 4 and 6, the lower valve stem end may include lower valve stem end cap 122, to ensure the positive engagement of the valve stem 104 with the valve actuating end of the upper compound lever arm. Alternatively, the lower valve stem end may be flared or a perpendicular pin may be used. One of ordinary skill in the art should appreciate that such variations will substantially achieve the same results of the illustrative embodiments shown in FIGS. 3 and 4.

In view of the above disclosure, one of ordinary skill in the art should understand and appreciate that one illustrative embodiment of the present invention includes a self-priming pump for pumping a fluid, the pump including: a centrifugal pump section, means for rotating the impeller shaft and a vacuum pump assembly. The centrifugal pump section includes: an intake; a volute, in which the volute is in fluid communication with the intake; an impeller disposed in the volute; an impeller shaft, in which the impeller is supported on the impeller shaft, and in which the impeller shaft has a drive end opposite the impeller; and a bearing housing, in which the impeller shaft is supported in the bearing housing. Operatively coupled to the drive end of the impeller shaft is a means for rotating the impeller shaft. Such means for rotating may include an electric motor, an internal combustion engine, turbines, or even animal or human force sufficiently geared and leveraged to rotate the impeller shaft and thus pump water.

The vacuum pump assembly includes: a vacuum pump and a priming chamber, in which the priming chamber is in vacuum communication with the vacuum pump. Thus, generating a vacuum in the priming chamber by the vacuum pump causes the fluid to be drawn into the intake and the volute, at least partially, into the priming chamber, thus priming the centrifugal pump section so that the centrifugal pump can pump the fluid. The improvement of the present invention includes a priming vacuum control valve and a priming vacuum control valve-actuating system as is substantially described herein.

In one such illustrative embodiment, the priming vacuum control valve is disposed between the vacuum pump and the priming chamber so as to decouple the vacuum communication between the vacuum pump and the priming chamber when the priming vacuum control valve is closed. One such illustrative priming vacuum control valve includes a valve stem with an elastomeric valve stem seal positioned between the upper valve stem end and the lower valve stem end; and a valve body that includes a valve body opening surrounded by a valve body seat. The valve body opening serves as a means for vacuum communication between the vacuum pump and the priming chamber. It should also be noted that the elastomeric valve stem seal is of a size and shape such that it generally corresponds with the size and shape of the valve body seat. The valve stem and valve body are in operative relation to each other as should be apparent to one of skill in the art. In one illustrated embodiment the valve body seat is tapered in a manner well known in the art and the elastomeric valve stem seal includes a combination of a shoulder with an o-ring sized to fit within the tapered valve body seat. Also included is a means for biasing the elastomeric valve stem seal against the valve body seat. The means for biasing is operatively positioned so as to apply a default closing force between the valve body and the valve stem so as to form a vacuum tight seal between the elastomeric valve stem seal and the valve body seat. Exemplary of such means is a valve spring, preferably a coil spring, however, other biasing means or springs, may be used to achieve substantially the same result. A means for retaining the biasing means in an operatively biasing relationship between the valve body and the valve stem is included in the present illustrative embodiment. Such means may include an upper valve stem cap coupled to the upper valve stem end such that it compresses the biasing means slightly. A biasing means seat may also be included to ensure the proper positioning of the biasing means. In one preferred and illustrative embodiment, the means for retaining includes the combination of an adjustable upper valve stem cap attached to the upper valve stem end and spring seat around the outside vacuum pump side of the valve body opening. Alternatively, the means for retaining may be a plate or a perpendicular pin or some similar structure. In another illustrative embodiment, the position of the upper valve stem cap is vertically adjustable along the valve stem so as to permit the adjustment of the default closing force applied by the biasing means between the elastomeric valve stem seal and the valve seat. This may be readily achieved as is shown in the figures.

The present illustrative embodiment also includes a priming vacuum control valve-actuating system operatively coupled to the priming vacuum control valve. One such illustrative priming vacuum control valve-actuating system includes an actuator bracket, as upper compound lever arm, and a lower compound lever arm each of which is pivotally mounted to actuator bracket at the upper pivot point and the lower pivot point respectively. The exemplary actuator bracket is fixedly mounted inside the priming chamber by any suitable means. The upper compound lever arm has a valve-actuating end, a link arm end and a pivot point positioned between the valve-actuating end and the link arm end through which it is operatively coupled to the actuator bracket. The lower compound lever arm has a link arm end and a float rod end and a pivot point positioned between the link arm end and the float rod end, by which the lower compound lever arm is pivotally coupled to the actuator bracket at the lower pivot point. A link arm is utilized in the illustrative embodiment to pivotally connect one end of the link arm to the link arm end of the upper compound lever arm and to pivotally connect the other end of the link arm to the link arm end of the lower compound lever arm. A float rod, which has a lower compound lever arm connecting end, is operatively coupled to the float rod end of the lower compound lever arm. The float rod is also operatively coupled on the other end, i.e. the float connecting end, to a float in the priming chamber. The float may be of any suitable shape and size so long as it is capable of substantially vertical movement within the priming chamber in response to the fluid level in the priming chamber.

The illustrative system is designed such that the downward motion of the float within the priming chamber results in the transfer of a valve opening force to the lower portion of the valve stem. When the valve opening force is greater than the default closing force, the valve is opened. In one preferred and illustrative embodiment, the valve-actuating end of the upper compound lever arm is fork shaped, however, the valve-actuating end may be "J" shaped or "V" shaped. The precise shape of the valve actuating end is of little consequence, so long as the valve-actuating end is capable of being disengagedly coupled to the lower valve stem end.

Another illustrative embodiment of the present invention includes a priming vacuum control valve for a self-priming pump, in which the priming vacuum control valve is disposed between a vacuum pump and a priming chamber for the self-priming pump so as to decouple the vacuum communication between the vacuum pump and the priming chamber when the priming vacuum control valve is closed. Such an illustrative priming vacuum control valve includes: a valve stem in operative relationship to a valve body.

The valve stem has an upper valve stem end and a lower valve stem end, and a valve stem shoulder positioned between the upper valve stem end and lower valve stem end. An elastomeric valve stem seal, such as an o-ring or other similar such structure, is positioned above the valve stem shoulder. As will become apparent, the valve stem shoulder and the elastomeric valve stem seal are designed to work in conjunction with a tapered valve body seat in the valve body to form a vacuum tight seal.

Although already mentioned, the illustrative embodiment includes a valve body having a valve body opening which forms a route of vacuum communication between the vacuum pump and the priming chamber. The valve body opening has a vacuum pump side and a priming chamber side between which is positioned a tapered valve body seat. A valve spring seat surrounds and generally defines the valve body opening on the vacuum pump side and a splash shroud surrounds and generally defines the valve body opening on the priming chamber side. An upper valve stem cap connected to the upper valve stem end, and a valve spring is operatively positioned between the valve spring seat of the valve body and the upper valve stem cap of the valve stem. The combination is designed such that the valve spring is loaded so as to apply a default closing force between the valve body and the valve stem. This results in the formation of a vacuum tight seal between the elastomeric valve stem seal and the tapered valve body seat. In one illustrative embodiment, the position of the upper valve stem cap is vertically adjustable along the valve stem so as to permit the adjustment of the default closing force applied by the valve spring between the valve stem and the valve body.

Yet another illustrative embodiment of the present invention includes priming vacuum control system for use on a self-priming pump. One such illustrative embodiment includes a priming vacuum control valve and a priming vacuum control valve-actuating system. The priming vacuum control valve is disposed between a vacuum pump and a priming chamber for the self-priming pump so as to decouple the vacuum communication between the vacuum pump and the priming chamber when the priming vacuum control valve is closed. An illustrative and preferred embodiment of the priming vacuum control valve includes a valve stem having an upper valve stem end and a lower valve stem end; and a valve stem seal positioned between the upper valve stem end and the lower valve stem end. The illustrative priming vacuum control valve also includes a valve body with a valve body opening and a tapered valve body seat positioned within the valve body opening between the vacuum pump side and the priming chamber side of the valve body opening. A spring seat is included such that it at least partially surrounds the valve body opening on the vacuum pump side. An upper valve stem cap is connected to the upper valve stem end and this works in combination with the spring seat so that a valve spring is operatively positioned between the spring seat of the valve body and the upper valve stem cap of the valve stem and applies a default closing force between the valve body and the valve stem. As a result of this default closing force, there is formed a vacuum tight seal between the elastomeric valve stem seal and the tapered valve body seat.

In addition to the illustrative priming vacuum control valve, the present illustrative embodiment includes a priming vacuum control valve-actuating system as substantively described herein. Such an illustrative system is designed such that a downward motion of a float within the priming chamber results in the transfer of a valve opening force to an upper compound lever arm, which in turn frictionally engages the valve-actuating end of the upper compound lever arm to the lower portion of the valve stem. When the valve opening force is greater than the default closing force, the valve is opened.

Such a system includes an actuator bracket, which is fixedly mounted inside the priming chamber and having an upper pivot point and a lower pivot point; an upper compound lever arm which has a valve-actuating end, a link arm end, and a pivot point positioned between the valve-actuating end and the link arm end, in which the upper compound lever arm is pivotally coupled to the actuator bracket at the upper pivot point. The valve-actuating end is designed such that it is disengagedly coupled to the lower valve stem end. Also included is a lower compound lever arm, which has a link arm end and a float rod end and a pivot point positioned between the link arm end and the float rod end. The lower compound lever arm is pivotally coupled to the actuator bracket at the lower pivot point. A link arm is included and which is designed to be operatively coupled to the link arm end of the upper compound lever arm and to the link arm end of the lower compound lever arm. A float rod, which has a lower compound lever arm connecting end and a float connecting end is operatively coupled to the float rod end of the lower compound lever arm. The illustrative system includes a float which is positioned within the priming chamber such that the float is capable of substantially vertical movement within the priming chamber in response to the fluid level in the priming chamber. The float is operatively coupled to the float connecting end of the float rod, such that a downward motion of the float within the priming chamber results in the transfer of a valve opening force to the upper compound lever arm. As a result of this there is a frictionally engaging of the valve-actuating end of the upper compound lever arm to the lower portion of the valve stem. When the valve opening force is greater than the default closing force, the valve is opened.

It will also be appreciated by one or ordinary skill in the art that an illustrative embodiment of the present invention includes a priming vacuum control system for use on a self-priming pump. The illustrative priming vacuum control system includes a priming vacuum control valve and a priming vacuum control valve-actuating system. The illustrative priming vacuum control valve is disposed between a vacuum pump and a priming chamber for the self-priming pump so as to decouple the vacuum communication between the vacuum pump and the priming chamber when the priming vacuum control valve is closed.

In one illustrative and preferred embodiment, the priming vacuum control valve includes: a valve stem including an upper valve stem end and a lower valve stem end, and a valve stem sealing means positioned between the upper valve stem end and lower valve stem end; a valve body including a valve body opening and a valve seat positioned within the valve body opening; means for biasing the valve stem sealing means against the valve seat, the means for biasing being operatively positioned so as to apply a default closing force between the valve stem and the valve body so as to form a vacuum tight seal between the valve stem sealing means and the valve seat; and means for retaining the biasing means in an operatively biasing relationship between the valve body and the valve stem.

An illustrative and preferred embodiment of the priming vacuum control valve-actuating system includes: an actuator bracket which is fixedly mounted inside the priming chamber and having a pivot point; an upper compound lever arm having a valve-actuating end, a link arm end, and a pivot point positioned between the valve-actuating end and the link arm end. The illustrative upper compound lever arm is pivotally coupled to the actuator bracket at the pivot point, and is disengagedly coupled to the lower valve stem end. Also included is a float in the priming chamber, which is capable of substantially vertical movement within the priming chamber in response to the fluid level in the priming chamber.

Means for operatively coupling the link arm end of the upper compound lever arm to the float is utilized such that a downward motion of the float results in the transfer of a valve opening force to the upper compound lever arm. This results in the frictional engagement of the valve-actuating end of the upper compound lever arm to the lower valve stem end such that when the valve opening force is greater than the default closing force, the valve is opened.

Finally one of skill in the art should appreciate that the present invention also contemplates a method of retrofitting a self-priming pump with the priming vacuum control valve and with at least the upper compound control arm previously described. Such a retrofitting action can be carried out by installing between the vacuum pump and the priming chamber a priming vacuum control valve which includes: a valve stem having an upper valve stem end and a lower valve stem end, and a valve stem sealing means positioned between the upper valve stem end and lower valve stem end; a valve body including a valve body opening and a valve seat positioned within the valve body opening; means for biasing the valve stem sealing means against the valve seat, the means for biasing being operatively positioned so as to apply a default closing force between the valve stem and the valve body so as to form a vacuum tight seal between the valve stem sealing means and the valve seat; means for retaining the biasing means in an operatively biasing relationship between the valve body and the valve stem. In order to achieve the desirable results of the present invention, the retrofitting process also includes installing an upper compound lever arm as has been previously described. One of skill in the art upon inspection and review of the previously noted current state of the art self-priming centrifugal pump and having the benefit of this disclosure of the present invention should appreciate that with only minor modifications, if any, the prior art self-priming pump may be retro-fitted in a manner to substantially achieve the results and benefits of the present invention.

While the apparatus, compositions and methods of this invention have been described in terms of preferred or illustrative embodiments, it will be apparent to those of skill in the art that variations may be applied to the process described herein without departing from the concept and scope of the invention. All such similar substitutes and modifications apparent to those skilled in the art are deemed to be within the scope and concept of the invention as it is set out in the following claims.

What is claimed is:

1. A self-priming pump for pumping a fluid, the pump including: a centrifugal pump section including: an intake; a volute, wherein the volute is in fluid communication with the intake; an impeller disposed in the volute, an impeller shaft, wherein the impeller is supported on the impeller shaft, and wherein the impeller shaft has a drive end opposite the impeller; and a bearing housing, wherein the impeller shaft is supported in the bearing housing; means for rotating the impeller shaft, the means for rotating being operatively coupled to the drive end of the impeller shaft; and a vacuum pump assembly including: a vacuum pump; and a priming chamber, wherein the priming chamber is in vacuum communication with the vacuum pump, and wherein the generation of a vacuum in the priming chamber by the vacuum pump causes the fluid to be drawn into the intake, the volute and at least partially into the priming chamber, thereby priming the centrifugal pump section, the improvement comprising:

a priming vacuum control valve, wherein the priming vacuum control valve is disposed between the vacuum pump and the priming chamber so as to decouple the vacuum communication between the vacuum pump and the priming chamber when the priming vacuum control valve is closed, and wherein the priming vacuum control valve includes: a valve stem including an upper valve stem end and a lower valve stem end, and an elastomeric valve stem seal positioned between the upper valve stem end and lower valve stem end; a valve body including a valve body opening surrounded by a valve body seat; means for biasing the elastomeric valve stem seal against the valve body seat, the means for biasing being operatively positioned so as to apply a default closing force between the valve body and the valve stem so as to form a vacuum tight seal between the elastomeric valve stem seal and the valve body seat; means for retaining the biasing means in an operatively biasing relationship between the valve body and the valve stem; and a priming vacuum control valve-actuating system, the priming vacuum control valve-actuating system including: an actuator bracket, the actuator bracket being fixedly mounted inside the priming chamber and having an upper pivot point and a lower pivot point; an upper compound lever arm, wherein the upper compound lever arm has a valve-actuating end, a link arm end and a pivot point positioned between the valve-actuating end and the link arm end, wherein the upper compound lever arm is pivotally coupled to the actuator bracket at the upper pivot point, a lower compound lever arm, wherein the lower compound lever arm has a link arm end and a float rod end and a pivot point positioned between the link arm end and the float rod end, wherein the lower compound lever arm is pivotally coupled to the actuator bracket at the lower pivot point, a link arm, wherein the link arm is pivotally coupled to the link arm end of the upper compound lever arm and is pivotally coupled to the link arm end of the lower compound lever arm; a float rod, wherein the float rod has a lower compound lever arm connecting end and a float connecting end, wherein the lower compound lever arm connecting end of the float rod is operatively coupled to the float rod end of the lower compound lever arm; and a float in the priming chamber, the float being capable substantially vertical movement within the priming chamber in response to the fluid level in the priming chamber; and wherein the float is operatively coupled to the float connecting end of the float rod and wherein the downward motion of the float within the priming chamber results in the transfer of a valve opening force to the lower portion of the valve stem and when the valve opening force is greater than the default closing force, the valve is opened.

2. The priming vacuum control system of claim 1, wherein the valve-actuating end of the upper compound lever arm is fork shaped.

3. The priming vacuum control system of claim 1, wherein the means for biasing is a coil spring.

4. The priming vacuum control system of claim 1 wherein the means for retaining includes an upper valve stem cap coupled to the upper valve stem end.

5. A priming vacuum control system of claim 4 wherein the position of the upper valve stem cap is vertically adjustable along the valve stem so as to permit the adjustment of the default closing force applied by the biasing means between the elastomeric valve stem seal and the valve seat.

6. A priming vacuum control valve for a self-priming pump, wherein the priming vacuum control valve is disposed between a vacuum pump and a priming chamber for the self-priming pump so as to decouple the vacuum communication between the vacuum pump and the priming chamber when the priming vacuum control valve is closed, wherein the priming vacuum control valve includes: a valve stem including: an upper valve stem end and a lower valve stem end, a valve stem shoulder positioned between the upper valve stem end and lower valve stem end, and an elastomeric valve stem seal positioned above the valve stem shoulder; a valve body including: a valve body opening having a vacuum pump side and a priming chamber side; a tapered valve stem seat positioned within the valve body opening; and a valve spring seat surrounding the valve body opening on the vacuum pump side; an upper valve stem cap connected to the upper valve stem end, and a valve spring operatively positioned between the valve spring seat of the valve body and the upper valve stem cap of the valve stem so as to apply a default closing force between the valve body and the valve stem so as to form a vacuum tight seal between the elastomeric valve stem seal and the tapered valve seat.

7. The priming vacuum control valve of claim 6, wherein the valve body further comprises a splash shroud, the splash shroud being positioned around the valve body opening on the priming chamber side.

8. The priming vacuum control valve of claim 6 wherein the position of the upper valve stem cap is vertically adjustable along the valve stem so as to permit the adjustment of the default closing force applied by the valve spring between the valve stem and the valve body.

9. The priming vacuum control valve of claim 6, wherein the valve spring is a coil spring.

10. A priming vacuum control system for use on a self-priming pump, comprising: a priming vacuum control valve and a priming vacuum control valve-actuating system, wherein the priming vacuum control valve is disposed between a vacuum pump and a priming chamber for the self-priming pump so as to decouple the vacuum communication between the vacuum pump and the priming chamber when the priming vacuum control valve is closed, and wherein the priming vacuum control valve includes: a valve stem including: an upper valve stem end and a lower valve stem end; a valve stem seal positioned between the upper valve stem end and lower valve stem end; a valve body including: a valve body opening having a vacuum pump side and a priming chamber side; a tapered valve stem seat positioned within the valve body opening between the vacuum pump side and the priming chamber side; and a spring seat at least partially surrounding the vacuum body opening on the vacuum pump side; an upper valve stem cap connected to the upper valve stem end; a valve spring operatively positioned between the spring seat of the valve body and the upper valve stem cap of the valve stem so as to apply a default closing force between the valve body and the valve stem so as to form a vacuum tight seal between the elastomeric valve stem seal and the tapered valve seat; and wherein the priming vacuum control valve-actuating system included: an actuator bracket, the actuator bracket being fixedly mounted inside the priming chamber and having an upper pivot point and a lower pivot point; an upper compound lever arm, wherein the upper compound lever arm has a valve-actuating end, a link arm end, and a pivot point positioned between the valve-actuating end and the link arm end, wherein the upper compound lever arm is pivotally coupled to the actuator bracket at the upper pivot point, and wherein the valve-actuating end is disengagedly coupled to the lower valve stem end; a lower compound lever arm, wherein the lower compound lever arm has a link arm end and a float rod end and a pivot point positioned between the link arm end and the float rod end, wherein the lower compound lever arm is pivotally coupled to the actuator bracket at the lower pivot point; a link arm, wherein the link arm is operatively coupled to the link arm end of the upper compound lever arm and is operatively coupled to the link arm end of the lower compound lever arm; a float rod, wherein the float rod has a lower compound lever arm connecting end and a float connecting end, wherein the lower compound lever arm connecting end of the float rod is operatively coupled to the float rod end of the lower compound lever arm; and a float, wherein the float is positioned within the priming chamber such that the float is capable of substantially vertical movement within the priming chamber in response to the fluid level in the priming chamber; and wherein the float is operatively coupled to the float connecting end of the float rod, and wherein a downward motion of the float within the priming chamber results in the transfer of a valve opening force to the upper compound lever arm, thereby frictionally engaging the valve-actuating end of the upper compound lever arm to the lower portion of the valve stem, and wherein when the valve opening force is greater than the default closing force, the valve is opened.

11. The priming vacuum control system of claim 10, wherein the valve-actuating end of the upper compound lever arm is fork shaped.

12. The priming vacuum control system of claim 10, wherein the valve body further comprises a splash shroud, the splash shroud being positioned around the valve body opening on the priming chamber side.

13. The priming vacuum control system of claim 10 wherein the position of the upper valve stem cap is vertically adjustable along the valve stem so as to permit the adjustment of the default closing force applied by the valve spring between the valve stem and the valve body.

14. The priming vacuum control system of claim 10, wherein the valve spring is a coil spring.

15. A priming vacuum control system for use on a self-priming pump, comprising:

a priming vacuum control valve and a priming vacuum control valve-actuating system, wherein the priming vacuum control valve is disposed between a vacuum pump and a priming chamber for the self-priming pump so as to decouple the vacuum communication between the vacuum pump and the priming chamber when the priming vacuum control valve is closed, wherein the priming vacuum control valve includes: a valve stem including an upper valve stem end and a lower valve stem end, and a valve stem sealing means positioned between the upper valve stem end and lower valve stem end; a valve body including a valve body opening and a valve seat positioned within the valve body opening; means for biasing the valve stem sealing means against the valve seat, the means for biasing being operatively positioned so as to apply a default closing force between the valve stem and the valve body so as to form a vacuum tight seal between the valve stem sealing means and the valve seat; means for retaining the biasing means in an operatively biasing relationship between the valve body and the valve stem; and wherein the priming vacuum control valve-actuating system includes: an actuator bracket, the actuator bracket being fixedly mounted inside the priming chamber and having a pivot point; an upper compound lever arm, wherein the upper compound lever arm has a valve-actuating end, a link arm end, and a pivot point positioned between the valve-actuating end and the link arm end, wherein the upper compound lever arm is pivotally coupled to the actuator bracket at the pivot point, and wherein the valve-actuating end is disengagedly coupled to the lower valve stem end; a float in the priming chamber, the float being capable substantially vertical movement within the priming chamber in response to the fluid level in the priming chamber;

means for operatively coupling the link arm end of the upper compound lever arm to the float; wherein a downward motion of the float results in the transfer of a valve opening force to the upper compound lever arm, thus frictionally engaging the valve-actuating end of the upper compound lever arm to the lower valve stem end such that when the valve opening force is greater than the default closing force, the valve is opened.

16. The priming vacuum control system of claim 15, wherein the valve-actuating end of the upper compound lever arm is fork shaped.

17. The priming vacuum control system of claim 15, wherein the valve body opening has a vacuum pump side and a priming chamber side, and wherein the valve body further comprises a splash shroud, the splash shroud being positioned around the valve body opening on the priming chamber side.

18. The priming vacuum control system of claim 15, wherein the means for biasing is a valve spring.

19. The priming vacuum control system of claim 18, wherein the valve spring is a coil spring.

20. The priming vacuum control system of claim 15, wherein the means for retaining includes a valve stem cap operatively coupled to the upper valve stem end.

21. The priming vacuum control system of claim 20, wherein the position of the upper valve stem cap is vertically adjustable along the valve stem so as to permit the adjustment of the default closing force applied by the biasing means between the valve stem and the valve body.

22. A method of retrofitting a self-priming pump, wherein the pump includes: a centrifugal pump section including: an intake; a volute, wherein the volute is in fluid communication with the intake; an impeller disposed in the volute, an impeller shaft, wherein the impeller is supported on the impeller shaft, and wherein the impeller shaft has a drive end opposite the impeller; and a bearing housing, wherein the impeller shaft is supported in the bearing housing; and a vacuum pump assembly including: a vacuum pump; and a priming chamber, wherein the priming chamber is in vacuum communication with the vacuum pump, and wherein the generation of a vacuum in the priming chamber by the vacuum pump causes the fluid to be drawn into the intake, the volute and at least partially into the priming chamber, thereby priming the centrifugal pump section, the method comprising:

installing between the vacuum pump and the priming chamber a priming vacuum control valve, wherein the priming vacuum control valve includes: a valve stem including an upper valve stem end and a lower valve stem end, and a valve stem sealing means positioned between the upper valve stem end and lower valve stem end; a valve body including a valve body opening and a valve seat positioned within the valve body opening; means for biasing the valve stem sealing means against the valve seat, the means for biasing being operatively positioned so as to apply a default closing force between the valve stem and the valve body so as to form a vacuum tight seal between the valve stem sealing means and the valve seat; means for retaining the biasing means in an operatively biasing relationship between the valve body and the valve stem;

installing a upper compound lever arm, wherein the upper compound lever arm has a valve-actuating end, a link arm end and a pivot point positioned between the valve-actuating end and the link arm end, wherein the upper compound lever arm is pivotally mounted to an actuator bracket in the priming chamber and the linking arm end is operatively coupled to a float in the priming chamber, wherein the float is capable of substantially vertical movement within the priming chamber in response to the fluid level in the priming chamber, and wherein a downward motion of the float results in the transfer of a valve opening force to the upper compound lever arm, thus frictionally engaging the valve-actuating end of the upper compound lever arm to the lower valve stem end such that when the valve opening force is greater than the default closing force, the valve is opened.

23. The method of claim 22, wherein the valve-actuating end of the upper compound lever arm is fork shaped.

24. The method of claim 22, wherein the valve body opening has a vacuum pump side and a priming chamber side, and wherein the valve body further comprises a splash shroud, the splash shroud being positioned around the valve body opening on the priming chamber side.

25. The method of claim 22, wherein the means for biasing is a valve spring.

26. The method of claim 22, wherein the means for retaining includes a valve stem cap operatively coupled to the upper valve stem end.

27. The method of claim 26, wherein the position of the upper valve stem cap is vertically adjustable along the valve stem so as to permit the adjustment of the default closing force applied by the biasing means between the valve stem and the valve body.

* * * * *